United States Patent [19]

Colombo

[11] Patent Number: 4,928,429

[45] Date of Patent: May 29, 1990

[54] SECURITY VESTIBULE ENTRY FOR CONTROLLED ACCESS TO BANKS AND THE LIKE

[75] Inventor: Attilio Colombo, Busto Arsizio, Italy

[73] Assignee: Tonali S.p.A., Varese, Italy

[21] Appl. No.: 236,011

[22] Filed: Aug. 24, 1988

[30] Foreign Application Priority Data

Aug. 28, 1987 [IT] Italy ..... 21748A/87

[51] Int. Cl.[5] ..... E06B 3/34

[52] U.S. Cl. ..... 49/41; 49/42

[58] Field of Search ..... 49/41, 42, 67, 68

[56] References Cited

U.S. PATENT DOCUMENTS 4,545,630 10/1985 Izumi et al. ..... 49/41

FOREIGN PATENT DOCUMENTS 1030550 5/1958 Fed. Rep. of Germany .

1223699 3/1971 United Kingdom ..... 49/41

*Primary Examiner*—Kenneth J. Dorner

*Assistant Examiner*—Gerald A. Anderson

*Attorney, Agent, or Firm*—Rosen, Dainow & Jacobs

[57] ABSTRACT

In a security vestibule entry for controlled access to banks and the like enclosures, two walls of the vestibule have substantially circular arc bases, different diameters, and respective angular breadths whose sum is at least 360°, being mounted on respective concentrical circular tracks and forming vestibule doors. The security vestibule is reliable, simple in construction, and compact in size.

5 Claims, 2 Drawing Sheets

SECURITY VESTIBULE ENTRY FOR CONTROLLED ACCESS TO BANKS AND THE LIKE

Figure 1:
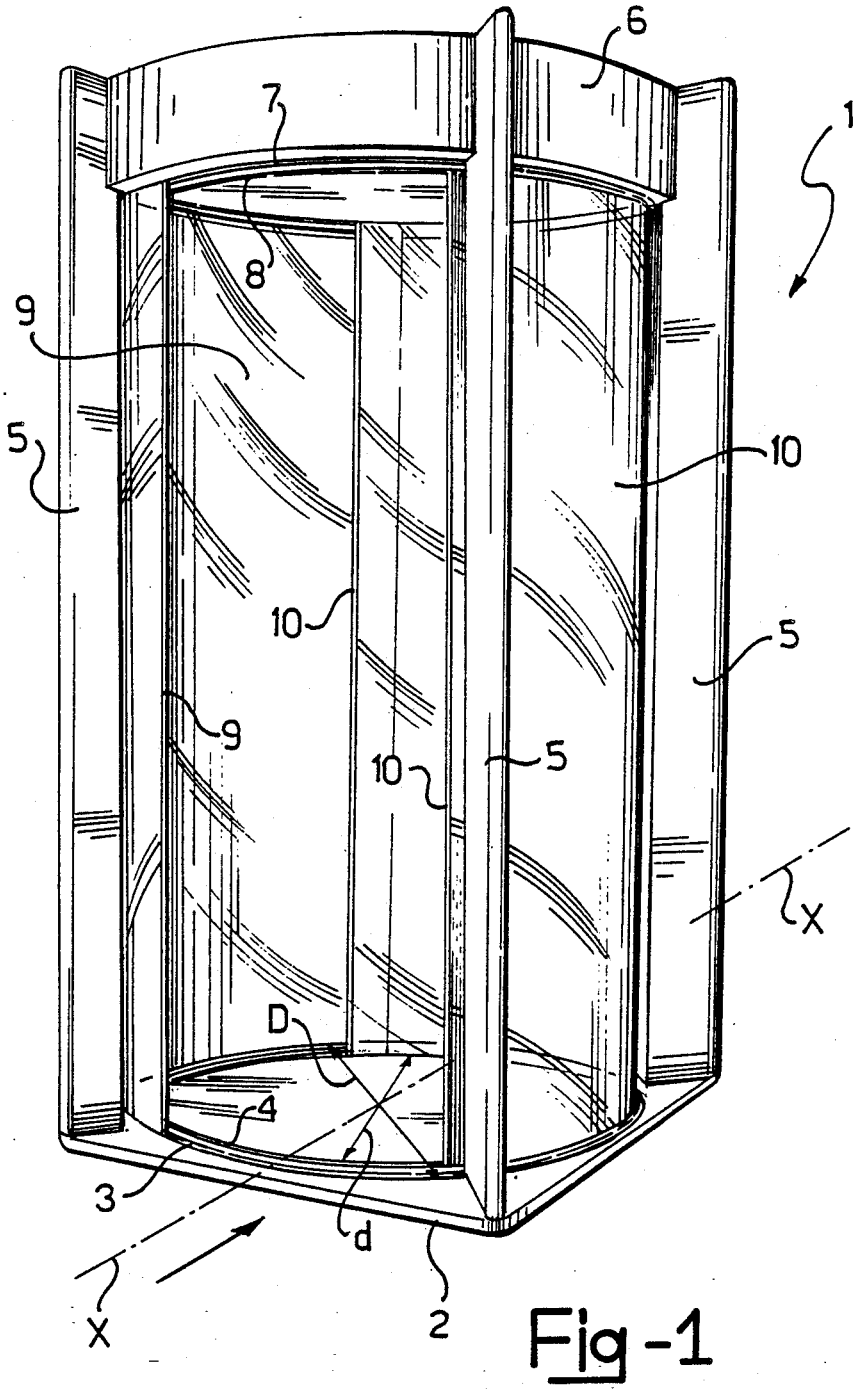

This invention relates to a security vestibule entry for controlled access to banks and the like.

As is well known, for security reasons, vestibule entries of banks and the like enclosures requiring controlled access, are to disallow, in normal conditions, any persons from entering and exiting an enclosure unchecked.

In the particular instance of banks, such security vestibule entries must be made from bullet-proof materials to resist robbing attacks.

Further, there exists a need for controlling a security vestibule to its "shut" condition in order to cut off a person therein, such as on the occasion of an alert situation resulting from a conventional metal detector having been tripped.

For these reasons, security entries are usually equipped with a barrier system vestibule formed basically of a booth-like structure with two doorways; each doorway has a respective door, for either manual or automatic opening, which is hinged to the structure and provided with some interlocking closure means, e.g. locks or magnets, which only permit one door to be opened after the other door has been shut.

This first type of security vestibule is, however, of a considerable size which cannot be reduced because this would make the passage inconvenient to use. Moreover, the passage times through the vestibule, which are tied to the door opening and closing times, would still be unsatisfactory because, with security vestibules of the type noted above, the passage times can only be shortened by increasing the door driving rates, which brings about obvious safety as well as engineering problems due to the heavy weight of such ballistic barrier doors.

Other conventional security vestibules comprise booths having bullet-proof walls and automatically operated interlocked doors slidable along runways; such prior vestibules, and in particular those having sliding doors with an arcuate base for sliding along circular runways, can be made smaller than the first-mentioned type, but their construction is more complex and their door opening/closing times continue to be unsatisfactory.

Also known are security vestibules including a booth apertured at opposed ends thereof, which are provided with a circular base partition formed with a 90° opening. The partition can be turned within the booth so as to bring its opening to register with either of the booth apertures.

These known-type vestibules have the well-recognized disadvantage that they hinder quick escaping from the enclosure in an emergency, and fail to afford unobstructed passage to handcarts, as allowed instead by the previously reviewed vestibules on disabling the door interlocking mechanisms.

An additional drawback of partitioned security vestibules is that with angled entries where the booth apertures are 90° away from each other, in normal operating conditions, the partition would have to complete a 270° rotation each time, in order to avoid communicating the two booth apertures directly with each other, and this would evidently entail a long passage time.

In order to reduce such passage time through the vestibule, and specifically to shorten the time required to open and close the doors, security vestibules have been proposed which also include a booth with two apertures, but have a door mounted at each aperture consisting of two sliding door wings adapted to be driven simultaneously toward and away from each other.

In this way, the door opening, or closing, time is halved, but at the expense of a greatly complicated vestibule construction and an increase of its bulk dimensions.

A further conventional security vestibule comprises a bullet-proof booth having a cylindrical interior shape and being provided with a revolving "gate" made up of plural segments. A vestibule to this design allow simultaneous in and out passage, but have large sizes, hinder panic escape from the enclosure, and are generally unreliable security-wise.

The problem underlying this invention is to provide a security vestibule for controlled access, which has such structural and operational features as to obviate the drawbacks affecting the prior art.

This problem is solved according to the invention by a security vestibule being characterized in that it comprises two walls having a base shape substantially following an arc of a circle, different diameters, and respective angular spans whose combined breadth is no less than 360°, said walls being carried slidingly on respective concentrical circular runways or tracks and forming doors for the vestibule.

The features and advantages of a security vestibule according to the invention will be more clearly understood from the following detailed description of a preferred embodiment thereof, to be taken by way of example and not of limitation in conjunction with the accompanying drawings.

In the drawings:

FIG. 1 is a perspective view showing schematically a security vestibule according to the invention; and FIGS. 2 to 7 are schematical and fragmentary plan views of the security vestibule shown in FIG. 1 at various stages of its operation.

With reference to the drawing views, generally indicated at 1 is a security vestibule according to the invention, for use as a controlled access entry to banks and the like enclosures.

The security vestibule 1 comprises a base plate 2 of square shape, on which two concentrical circular runways or tracks are formed, the outermost runway with a diameter D being designated 3, and the innermost runway with a slightly smaller diameter d than the diameter D being designated 4.

Four vertical uprights or supports 5 have the same length are mounted on the corners of the base plate 2.

The reference numeral 6 denotes an upper plate or top supported on the uprights 5 and extending parallel to the base plate 2; the upper plate 6 is also provided with two concentrical circular runways or tracks 7 and 8, having respective diameters D and d and arranged to face the runways 3 and 4.

The security vestibule 1 of this invention has two sheet-like walls 9 and 10 having respective circular arc-shaped bases of predetermined angular breadth A and a, and diameter D and d, respectively. The base plate 2 and the upper plate 6 close the vestibule off at opposed ends thereof, and the base plate 2 is suitably constructed to support a person or persons passing through the vestibule.

It is important to observe that the sum of the angular breadths A and a, of the walls 9 and 10, exceeds 360° by a small margin or amount. Particularly in the example under consideration, the angular breadths A and a are identical and equal to 190°.

In addition, the walls 9 and 10 are bullet-proof and formed preferably from ballistic barrier glass.

The wall pair, 9 and 10, extend between the plates 2 and 6, and are mounted for sliding movement or displacement along the runways 3, 7 and 4, 8, respectively.

According to the invention, the walls 9 and 10 constitute access doors for the vestibule 1, and define an entrance to and an exit from the vestibule as explained more clearly hereinafter.

Also provided are motive means, known per se and not illustrated, for driving the walls 9 and 10 along their respective runways, and conventional sensor means, such as sensing platforms, photocells, and the like, for operating said motive means, as well as control means, such as travel limit switches, to stop said motive means and halt the walls 9 and 10 at selected positions.

Figure 2:
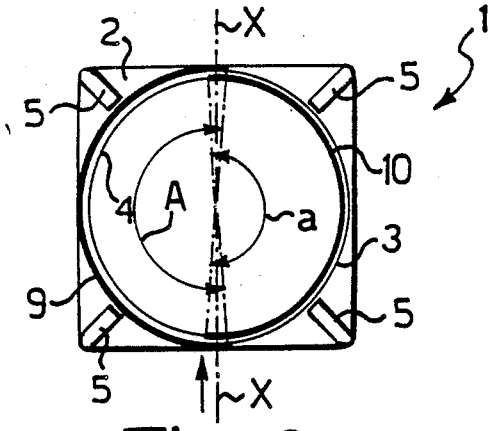
Figure 3:
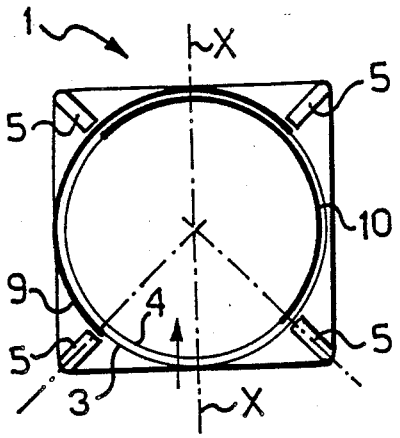
Figure 4:
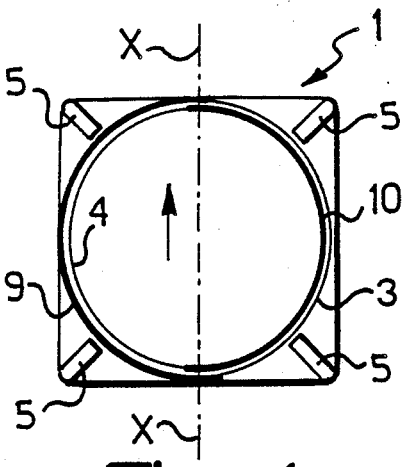

The operation of the security vestibule 1 for controlled access to banks and the like enclosures, will be described herein below with reference to a starting condition under which the vestibule would be "closed", as shown in FIG. 2.

Under that condition, the concave sides of the walls 9 and 10 face each other and the centerline of the vestibule 1, which centerline is indicated at X—X and identifies a passage direction through the vestibule; accordingly under that condition, the passage through the vestibule 1, in the direction shown by the arrow in the drawing, would be blocked by the walls 9 and 10.

Also under that condition, the opposedly located walls 9 and 10 would define an enclosed space therebetween.

It is important to observe that since the sum of the angular breadths of the walls 9 and 10 is greater than 360°, such walls will overlap each other by a predetermined distance at the line X—X. In the example shown, the overlap is of 10°.

On said sensor means becoming activated, such as on account of someone approaching the vestibule from the enclosure outside, the motive means will drive the walls 9 and 10 simultaneously along their respective runways 3, 7 and 4, 8, to cause them to complete an angular movement of about 45° (50° in the particular example under consideration). Thus, an aperture or entrance about 90° in breadth is uncovered which faces outside from the enclosure and through which access can be had to the interior of the vestibule 1 (see FIG. 3).

Figure 5:
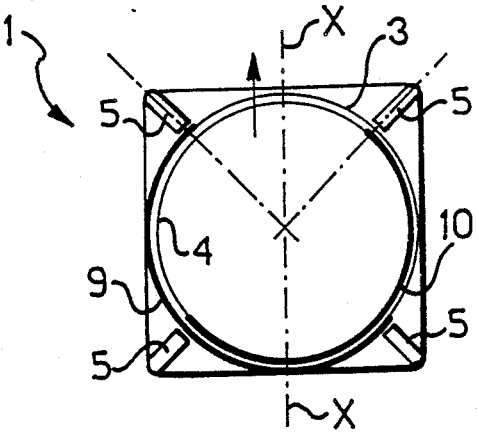
Figure 6:
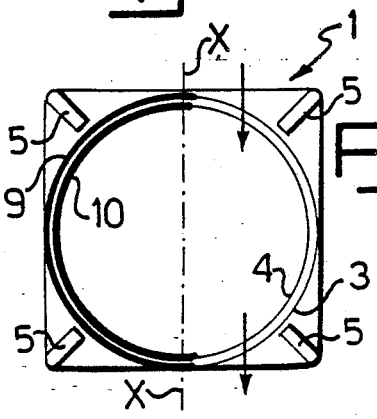

At this point, the motive means are again operated to drive the walls 9 and 10, presently partly overlapping each other, slidingly through approximately another 45°, but in the opposite direction, thereby the vestibule 1 is restored to its "closed" condition (see FIG. 4) and the person inside the security vestibule 1 can be checked and recognized.

Where the checking procedure is passed, e.g. if no metal objects such as weapons and the like are detected, the motive means will again drive both walls 9 and 10 through about 90° to uncover an aperture or exit of about 90° toward the enclosure interior, through which the entering person can now be admitted (see FIG. 5).

After the visitor has gone through the security vestibule 1, the motive means are once again operated to restore the vestibule 1 to its original "closed" condition.

The passage through the vestibule 1 in the opposite direction, i.e. exiting the enclosure, takes place in exactly the same way as described above.

Figure 7:
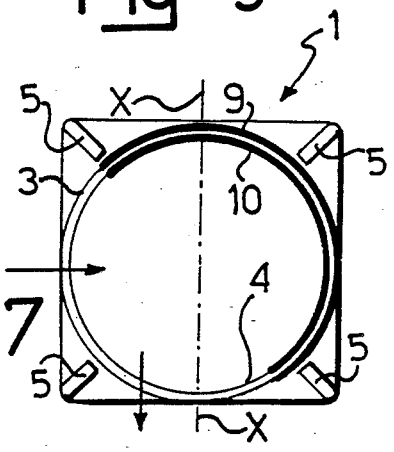

It is important to observe that in the event of an emergency exit from the enclosure, the motive means for the vestibule 1 would be operated, and one of the walls 9 or 10, preferably the wall 10, would be driven along its respective runways 4 or 8 from the "closed" position through an arc of 180° close against the other wall, thereby the concave sides of either will be facing in the same direction toward the line X—X. Thus, the passage through the vestibule 1 is unimpeded (see FIG. 6).

Where the small size of the security vestibule 1 disallows an easy pasage under the condition depicted in FIG. 6, and again on the occasion of an emergency exit from the enclosure, the walls 9 and 10 would be driven, the one through 45° and the other 135° so as to gather them together with their respective concave sides facing in one direction, at about 45° to the line X—X (see FIG. 7).

The security vestibule of this invention has shown to be highly reliable as well as uncommonly simple construction-wise and compact in size, primarily on account of its two sliding walls forming doors for the vestibule and providing a "closed" condition of the vestibule for the benefit of the secure enclosure.

In addition, owing to the substantially semicircular base configuration of the two walls/doors, in order to open and close the vestibule, small angular displacements of said walls/doors are adequate. For this reason, and because such displacements are performed simultaneously, the passage times through the vestibule can be quite short.

An additional advantage of the security vestibule according to the invention is that it can be readily assembled to fit a wide range of access ways from a reduced number of components.

In particular, this vestibule may be used with either corner entries or straight entries, as well as with so-called self-operated security entries (cf., for example, Italian Patent Application No. 22267-A/87 by this same Applicant), wherein access is provided to the interior of a building, or alternatively to a passage space separated from the building and only utilized on activation of a metal detector mounted at the entry.

In this case, in fact, the sliding door movements may be easily controlled by said detector to give access into the building under normal conditions, or give access to the passage space by appropriate rotations of the walls.

The security vestibule entry disclosed herein above is obviously susceptible to many changes and modifications without departing from the true scope of the invention as set forth in the appended claims.

I claim:

1. A security vestibule comprising a base, a top, a first wall extending from said base to said top along an arc of a circle having a first diameter, a second wall extending from said base to said top along an arc of a circle having a second diameter larger than said first diameter, opposed first circular tracks associated with said base and said top for engaging said first wall for displacement along said first tracks, opposed second circular tracks associated with said base and said top for engaging said second wall for displacement along said second tracks, said second tracks being concentric with and of larger diameter than said first tracks, said first and second walls forming doors of said vestibule and having a combined angular breadth equal to or greater than by a small amount 360°, said base and said top closing said vestibule at opposed ends thereof and said walls in selected positions thereof defining an entrance into and an exit from said vestibule across at least a portion of said base, said base being suitable for supporting at least one person thereon for passage through said vestibule between said entrance and said exit, and four vertically extending supports for supporting said top, said supports being at corners of a square having sides adjacent one of said first and said second tracks.

2. The security vestibule according to claim 1 wherein each of said walls is mounted for displacement in clockwise and counterclockwise directions.

3. The security vestibule according to claim 1 wherein said first and second walls extend continuously along their respective arcs.

4. The security vestibule according to claim 1 wherein said first and second walls have substantial breadths in relation to each other.

5. The security vestibule according to claim 1 wherein said first and said second walls have equal angular breadths.

* * * * *